US005655252A

United States Patent [19]

Miyawaki et al.

[11] Patent Number: 5,655,252

[45] Date of Patent: Aug. 12, 1997

[54] DUST-REMOVING APPARATUS

[75] Inventors: Hiroshi Miyawaki; Keiji Morimoto; Takahisa Miyamori, all of Wakayama, Japan

[73] Assignee: Noritsu Koki Co., Ltd., Wakayama-ken, Japan

[21] Appl. No.: 418,983

[22] Filed: Apr. 7, 1995

[30] Foreign Application Priority Data

Apr. 8, 1994 [JP] Japan ..... 6-70331
Sep. 29, 1994 [JP] Japan ..... 6-234722

[51] Int. Cl.[6] ..... B08B 11/02

[52] U.S. Cl. ..... 15/308; 15/22.3; 15/256.53; 15/309.1

[58] Field of Search ..... 15/308, 256.53, 15/309.1, 306.1, 309, 22.3, 88.1

[56] References Cited

U.S. PATENT DOCUMENTS 582,209 5/1897 Seufert ..... 15/22.3 X
1,689,497 10/1928 Morgal ..... 15/380
2,171,631 9/1939 Moncrieff et al. ..... 15/88.1
2,524,928 10/1950 Platz ..... 15/380 X
3,139,975 7/1964 Schaefer ..... 15/380 X
3,398,022 8/1968 Maust ..... 15/308 X
4,706,325 11/1987 Michelson ..... 15/308
5,286,303 2/1994 Avelis ..... 15/308 X

*Primary Examiner*—Chris K. Moore
*Attorney, Agent, or Firm*—Felfe & Lynch

[57] ABSTRACT

A dust-removing apparatus for removing dust from a dusty surface of a material. The apparatus includes a dust-removing member for picking up dust from a dusty surface in association with continuous and alternate movement of various portions of a dust-removing face thereof to a removing position and also a take-off member for taking the dust off the dust-removing face of the dust-removing member through contact thereof with each of the various portions of the dust-removing face when the portion comes to a non-removing position.

13 Claims, 12 Drawing Sheets

DUST-REMOVING APPARATUS

BACKGROUND OF THE INVENTION

1. Field of the Invention

The present invention relates to an apparatus for removing dust from a dusty surface of e.g. a photosensitive material.

2. Description of the Related Art

A dust-removing apparatus of the above-noted functions to remove dust adhered to a surface of a photosensitive material such as a negative which is transported along a transport passage.

A conventional apparatus provides e.g. a dust-removing member such as a brush fixedly disposed at a location in the transport passage of the material, so that the dust-removing operation is effected as the brush picks up the dust from the material which is transported through the location of the brush.

With the above-described conventional art, however, the dust-removing member such as the brush is fixedly disposed and the dust is removed from the material surface in association with the transportation of the material. Hence, the dust-removing capacity of the apparatus is significantly limited. Further, if the brush has some irregularity in the density of its bristles or the pick-up action of the dust by the brush occurs at some portion of the brush in a concentrated manner, this leads to local concentration, i.e. unevenness, in the dust removing operation.

The present invention is addressed to the above-described problem and a first object of the invention is to provide a dust-removing apparatus for e.g. a photosensitive material, which may reliably remove dust adhered to a surface of the material.

A second object of the present invention is to facilitate proper maintenance of the transported material within the transport passage, while achieving the first object.

SUMMARY OF THE INVENTION

For fulfilling the above-noted object, a dust-removing apparatus, according to the present invention, comprises:

a dust-removing member for picking up dust from a dusty surface in association with continuous and alternate movement of various portions of a dust-removing face thereof to a removing position; and a take-off member for taking the dust off the dust-removing face of the dust-removing member through contact thereof with each of the various portions of the dust-removing face when the portion comes to a non-removing position.

With the above-described construction, the dust-removing operation is effected as various portions of the dust-removing face of the dust-removing member continuously and alternately come into contact with the dusty surface, the dust adhered to the surface may be removed extensively and efficiently.

So that, the invention has provided a dust-removing apparatus which may reliably remove dust adhered to a surface of the material.

According to one aspect of the invention, the dust-removing member comprises an endless belt entrained to contact front and back faces of a sheet-like photosensitive material transported along a transport passage, and drive means is provided for rotatably driving the endless belt to provide the dust-removing action.

With the above construction, the dust-removing member, constructed as an endless belt, is entrained to contact the front and back faces of the sheet-like photosensitive material and this belt is rotatably driven by the drive means to provide the dust-removing action.

That is, with rotational movement of the endless belt dust-removing member, various portions of the belt come into contact with the material continuously and alternately, so that dust adhered to the front and back faces of the photosensitive material may be removed extensively, evenly and efficiently.

Hence, in this case too, the invention has provided a dust-removing apparatus which may reliably remove dust adhered to a surface of the material.

According to one preferred mode of the present invention, the endless belt as the dust-removing member is rotatably driven in a direction transverse to a direction of the transport passage of the material.

With this construction, as the endless belt dust-removing member is driven to run in the direction transverse to the transport direction of the photosensitive material, any remaining dust not picked up by the dust-removing member may be swept away off the transport passage of the photosensitive material.

As a result, the removing operation of the dust from the photosensitive material may be effected more reliably.

According to a further aspect of the present invention, the endless belt includes a pair of contact portions contacting respectively the front and back faces of the photosensitive material, and the endless belt is driven in such a manner that the contact portions are driven to run in opposite directions to each other at a common location relative to the transport direction of the photosensitive material.

With the above construction, one contact portion of the endless belt contacting the front face of the sheet-like photosensitive material and the other contact portion of the same contacting the back face of the material are located at a same location relative to the transport direction of the material and these contact portions are both driven in directions transverse to the transport and also opposite to each other. Therefore, the forces applied to the material in association with the rotational drive of the endless belt may be canceled by each other on the front and back sides of the photosensitive material.

As a result, the construction may facilitate proper maintenance of the transported photosensitive material on the transport passage.

According to a still further aspect of the invention, the apparatus further comprises suction means disposed adjacent the dust-removing face of the dust-removing member contacting the photosensitive material for sucking the dust from the dust-removing face.

With the above construction, the dust picked up by the dust-removing member from the photosensitive material is eliminated therefrom by being sucked by the suction means.

As a result, it is possible for the dust-removing member to maintain high dust-removing capacity and also to effectively prevent the dust once adhered to the dust-removing member from being re-adhered to the photosensitive material to cause damage to the material. Hence, the dust removing operation may be effected even more reliably.

According to a still further aspect of the invention, the endless belt as the dust-removing member is entrained in such a manner as to have a curved portion away from the photosensitive material, and the suction means sucks the dust from the dust-removing member at the curved portion of the dust-removing member.

With the above construction, the endless belt as the dust-removing member is rotatably driven to run in the direction transverse to the transporting direction of the photosensitive material and this endless belt has the curved portion which is disposed away from the photosensitive material.

Then, the dust is sucked from the endless belt by the suction means, at the curved portion of the belt.

At the curved portion of the endless belt, the face of this belt contacting the photosensitive material is stretched to facilitate detachment of the dust from the belt, i.e. the dust-removing member and the detachment is further promoted by a centrifugal force generated at the curved portion in association with the rotational drive of the belt. Accordingly, the suction of the dust by the suction means may take place very effectively.

Moreover, since the curved portion is located away from the photosensitive material, even if the suction means fails to suck the dust detached from this curved portion of the belt, the detached dust will not re-adhere to the photosensitive material.

As a result, the removal of dust adhered to the photosensitive material may be effected even more reliably.

According to a still further aspect of the invention, the dust-removing face of the dust-removing member contacting the photosensitive material is formed as a brushy face.

With this construction, as the dust-removing member is rotatably driven by the drive means, its dust-removing face constructed as a brushy face comes into contact with the photosensitive material to pick up dust therefrom.

As a result, the dust may be removed from the photosensitive material in a reliable manner.

According to a still further aspect of the present invention, the apparatus comprises:

a dust-removing member for picking up dust from a dusty surface in association with continuous and alternate movement of various portions of a dust-removing face thereof to a removing position; and a take-off member having an adhesive face for taking the-dust off the dust-removing face of the dust-removing member through adhesive contact thereof with each of the various portions of the dust-removing face when the portion comes to a non-removing position.

With the above-described construction, the dust-removing operation is effected as various portions of the dust-removing face of the dust-removing member continuously and alternately come into contact with the dusty surface, the dust adhered to the surface may be removed extensively and efficiently.

On the other hand, as at the non-removing position the adhesive face of the take-off member comes into adhesive contact with each portion of the dust-removing face of the dust-removing member thereby to remove the dust therefrom by the adhesive force.

That is, with such simple construction providing the take-off member having an adhesive face, the dust may be eliminated from the dust-removing face.

As a result, this apparatus provides effective and reliable dust take-off operation from the dust-removing face, despite its simple entire construction.

According to a still further aspect of the present invention, the dusty surface is present at both front and back faces of an elongate material such as a photosensitive material transported along a transport passage, and the dust-removing member picks up dust from the front and back dusty faces of the elongate material.

With the above construction, dust may be reliably removed from the front and face faces of the elongate material through the entire length thereof, without requiring means for moving the dust-removing member relative to the elongate material.

As a result, the dust removal operation from a dusty surface may be effected reliably while achieving further simplification of the entire apparatus construction.

According to a still further aspect of the invention, the dust-removing member has substantially cylindrical configuration, and the dust-removing face comprises a brushy peripheral face of the cylindrical dust-removing member to contact the dusty face. Drive means is provided for rotatably driving the dust-removing member about an axis extending through a center of substantially circular cross section of the cylindrical dust-removing member to cause the dust-removing face to contact the dusty surface.

With the above construction, in association with the rotation of the peripheral face of the dust-removing member, the peripheral face, i.e. the dust-removing face is continuously moved to the removing position contacting the dusty surface, so that the dust is picked up by this brushy dust-removing peripheral face.

That is, through the simple construction in which the dust-removing member having the brushy dust-removing face is rotatably driven, the dust removal operation may be effected reliably within a very limited space.

As a result, the entire apparatus construction may be formed even more simple.

According to a still further aspect of the invention, the take-up member has substantially cylindrical configuration and the adhesive face is formed in the peripheral face of the cylindrical take-up member.

This construction is advantageous for being simple and compact, in comparison with a construction in which a planar sheet-like adhesive face is fed in a serial manner.

As a result, the entire apparatus construction may be even more simple.

According to a still further aspect of the invention, the brush dust-removing face has electrically conductive property.

With this construction, dust may be efficiently removed from the dust-removing face by means of static electricity.

As a result, the dust-removing performance of the apparatus may be further improved.

According to a still further aspect of the invention, the dust-removing face has adhesive property at a predetermined portion thereof.

With the above construction, at the predetermined portion of the dust-removing face, dust may be removed from the dusty surface by means of the adhesive force.

That is to say, the dust-removing face includes both a brushy portion and an adhesive portion.

In general, the adhesive portion provides a stronger dust removing force than the brushy portion, so that the adhesive portion provides greater resistance against the relative movement between the dust-removing face of the dust-removing member and the dusty surface. Yet, the adhesive portion may remove the dust from the surface more reliably than the brushy portion.

Therefore, the adhesive portion will be provided, in the dust-removing face, only at such a portion where more reliable dust removal is desired in particular. Then, while minimizing the resistance against the relative movement between the dust-removing face and the dusty surface, such more effective dust removal operation may be effected in a concentrated manner for a certain desired portion of the dusty surface.

Consequently, the dust removal operation may be effected in accordance with the local condition of the dusty surface, so that the apparatus with this feature will be more convenient.

According to a still further aspect of the invention, the dust-removing member has substantially cylindrical configuration and is rotatable about an axis extending through a center of substantially circular cross section of the cylindrical dust-removing member, the dust-removing face comprises a peripheral face of the cylindrical dust-removing member and having adhesive force weaker than the adhesive force of the adhesive face of the take-off member.

With the above construction, the dust-removing member has substantially cylindrical configuration and its adhesive peripheral face as the dust-removing face comes into contact with the dusty surface for removing dust therefrom.

Further, since the adhesive force of the dust-removing face is weaker than the adhesive force of the adhesive face of the take-off member, the dust adhered to the dust-removing face may be removed therefrom through the contact between the adhesive face of the take-off member and the dust-removing face.

That is to say, the dust may be reliably removed from the dusty surface by the adhesive dust-removing face; and then this adhered dust may be removed therefrom by the take-off member.

As a result, the dust-removing performance of the apparatus may be further improved.

According to a still further aspect of the invention, the take-off member has substantially cylindrical configuration, and its adhesive face is formed in a peripheral face of the cylindrical take-off member.

With this construction, because of the take-off member having substantially cylindrical configuration, the entire apparatus may be formed compact, yet the dust may be effectively removed from the dust-removing member.

According to a still further aspect of the invention, the dusty surface comprises a planar portion of an elongate band-like material transported along a transport passage, a plurality of dust-removing members are disposed one after another along the length of the band-like material, each of the dust-removing members has a dust-removing face extending discontinuous relative to a direction of the rotary axis, and at least one of the dust-removing faces of the dust-removing members is present at any position within a predetermined area extending along a transverse width of the elongate band-like material.

With the above construction, the dust-removing face of each dust-removing member extends discontinuously relative to the direction of the rotary axis. Hence, compared with a construction in which the dust-removing face extends continuously in this direction, the dust-removing member applies a smaller adhesive force to the dusty planar face of the elongate band-like material.

If the dust-removing member provided an excessive adhesive force to the elongate band-like material, this dust-removing member might entangle the elongate band-like material thus hindering proper transportation thereof. On the other hand, with the reduction of the adhesive force applied from the dust-removing member to the material, such accident may be effectively avoided.

Further, as the plurality of dust-removing members are disposed in such a manner that at least one of the dust-removing faces of the dust-removing members is present at any position within a predetermined area extending along a transverse width of the elongate band-like material, no portion of the dusty surface can escape from the dust removal effect provided by the dust-removing face.

As a result, this construction achieves reliable dust removal from the dusty surface, while allowing proper transportation of the elongate band-like material.

According to a still further aspect of the invention, there is provided a brush roller for removing dust from an endless belt entrained to contact the dusty surface, and the take-up member eliminates the dust from the brush roller.

With the above construction, the dust adhered to the belt may be eliminated by means of the brush roller disposed at a position other than the removing position and this dust caught by the brush roller may be eliminated by means of the take-up member.

As a result, it is possible to prevent the dust from being re-adhered to the dusty surface, so that the dust removal operation may be effected efficiently.

According to a still further aspect of the invention, the brush roller has electrical conductivity.

With this, by removing the electric charge from the dust adhered to the belt by static electricity, the dust may be efficiently collected by the brush roller.

As a result, the dust-removing performance of the apparatus may be further improved.

According to a still further aspect of the invention, the dust-removing member comprises an endless belt entrained to contact the dusty surface, and an adhesive roller is provided for removing dust from the belt.

With this construction, it is possible to construct the dust-removing member from the adhesive roller alone.

As a result, the entire dust-removing apparatus may be formed compact.

According to a still further aspect of the invention, the dust-removing face is rendered movable between a first position where the dust-removing face provides no dust-removing effect to the dusty surface and a second position where the dust-removing face provides the dust-removing effect to the dusty surface.

This construction allows smooth and easy setting of the material to the dust-removing face of the apparatus.

As a result, even when the leading end of the material is curved or bent, this will not cause jamming of the material during its insertion into the apparatus, so that the dust-removing performance of the dust-removing apparatus will be further improved.

Further and other objects, features and effects of the invention will become more apparent from the following more detailed description of the embodiments of the invention with reference to the accompanying drawings.

DETAILED DESCRIPTION OF THE PREFERRED EMBODIMENTS

A first preferred embodiment of the invention relating to a dust-removing apparatus as attached to an image printer system, will be described next.

Figure 1:
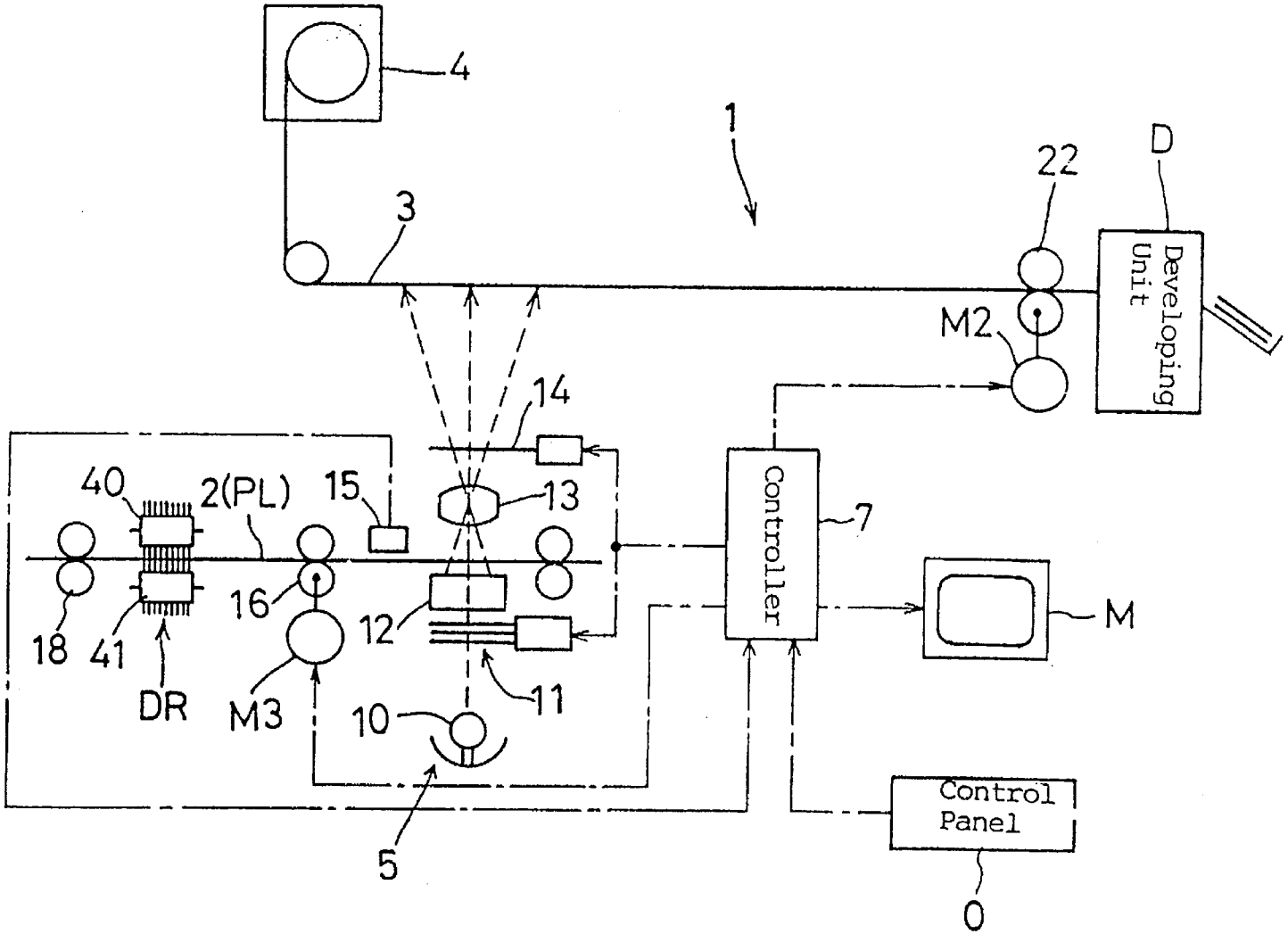
FIG. 1 is a schematic construction view relating to a first embodiment of the present invention.

As shown in FIG. 1, an image printer system 1 includes a projection exposure section 5 for projecting and exposing onto a print paper 3 an image of a sheet-like photographic photosensitive material PL such as a negative 2, and a developing section D for developing the exposed print paper 3.

The print paper 3 withdrawn from a print-paper magazine 4 in which the paper 3 is stored in a convoluted state, is exposed at the projection exposure section 5 and then developed at the developing section D. Thereafter, the print paper is cut into segments each containing one-frame amount of image information and discharged from the system.

Next, the respective components listed above will be described.

The projection exposure section 5 includes a projection exposure light source 10, a light modulating filter 11 for adjusting color balance of the light beam to be irradiated onto the negative 2, a mirror tunnel 12 for uniformly mixing the light passing through the light modulating filter 11, a printing lens for imaging the image information of the negative 2 on the print paper 3 and a shutter 14, with all the above elements being disposed on a common optical axis.

On the upstream side at the projection exposure section 5 of a transport passage of the negative 2, there is provided an image sensor 15 for reading the image information of the negative 2 in the form of a plurality of discrete areas. Referring more particularly to the function of the image sensor 15, a white light beam is irradiated on the negative 2 and the intensity of its reflected or transmission light is measured by means of e.g. a CCD line sensor or a CCD image sensor with the light being separated into the three primary color components of red, green and blue. The image information read by the image sensor 15 is then transmitted to a controller 7 to be used for obtaining exposure conditions at the projection exposure section 5 and also the controller produces and presents a simulated image on a monitor M, which simulated image would result from the read image information if exposed on the print paper 3 under the obtained exposure conditions.

On the upstream side of the image sensor 15 relative to the transport passage of the negative 2, there are provided rollers 16, 18 for feeding the negative 2 to the projection exposure section 5 and a motor M3 for rotatably driving the rollers 16, 18.

Between the rollers 16, 18 on the transport passage of the negative 2, there is provided a dust-removing apparatus DR for the negative 2. Front and back surfaces of the negative 2 comprise dusty surfaces 2*a* to be treated by the dust-removing apparatus.

Figure 2:
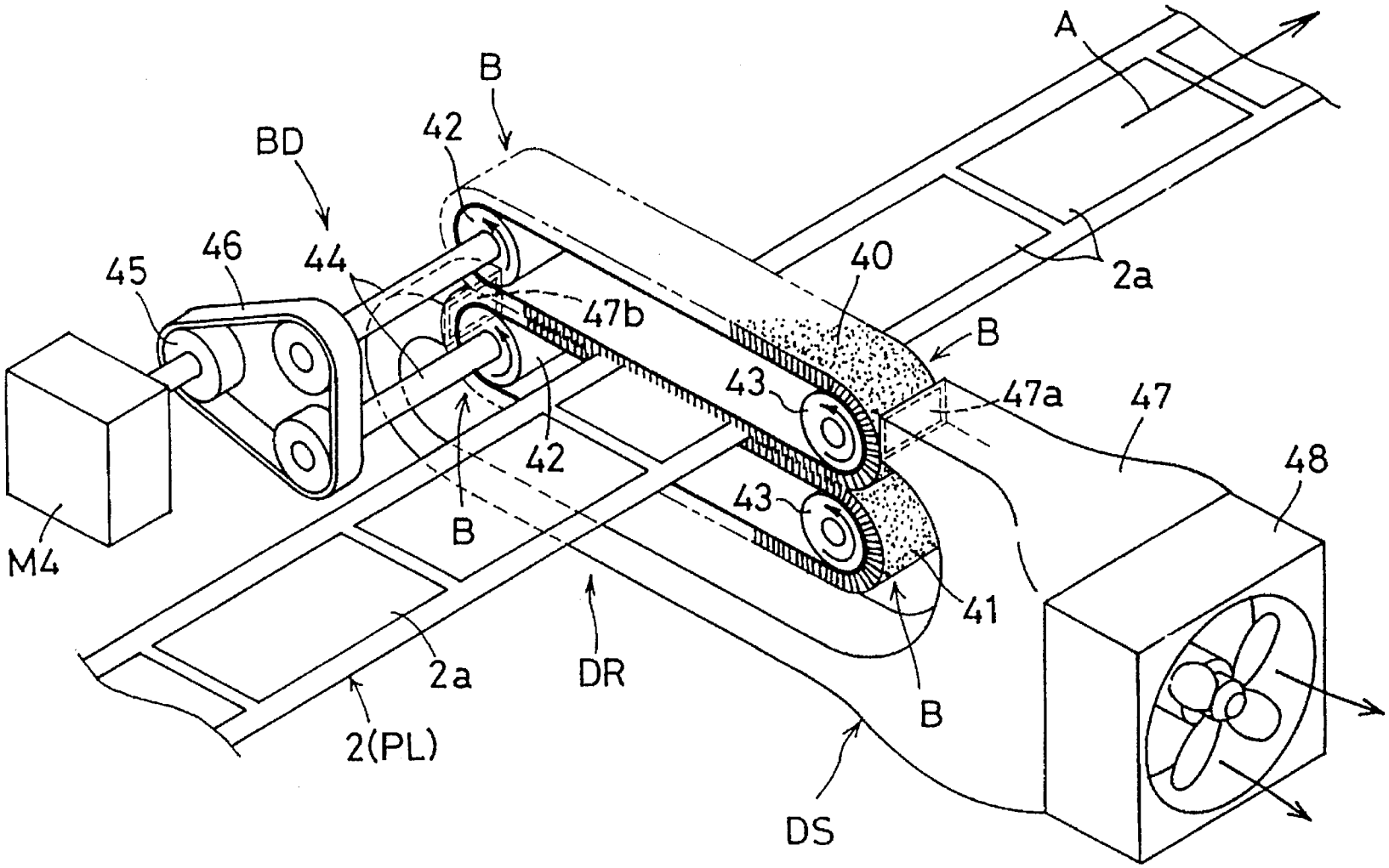
FIG. 2 is a perspective view of major portions relating to the first embodiment of the present invention.

The dust-removing apparatus DR, as shown in FIG. 2, includes upper and lower brush belts 40, 41 as dust-removing members in the form of endless belts disposed upwardly and downwardly of the transport passage of the negative 2, a suction means DS for sucking dust adhered to the upper and lower brush belts 40, 41 and a drive means BD for rotatably driving the upper and lower brush belts 40, 41. The suction means DS functions as a dust-take-off member DE.

The drive means BD includes drive rollers 42 and driven rollers 43 around which the brush belts 40, 41 are entrained, connector shafts 44 connected with the drive rollers 42, a motor M4 for rotatably driving the brush belts 40, 41, and a transmission belt 46 entrained around a motor roller 45 mounted at a leading end of a rotary shaft of the motor M4 and also leading ends of the two connector shafts 44 for transmitting the drive force of the motor M4. Then, in operation< the brush belts 40, 41 are driven to rotate counterclockwise as viewed from the transport direction of the negative 2.

The suction means DS includes an air duct 47 having openings 47*a*, 47*b* respectively at a position adjacent the driven roller 43 about which the upper brush roller 40 is entrained and a further position adjacent the drive roller 42 about which the lower brush belt 41 is entrained, and also a fan 48 communicated with the air duct 47. The fan 48 is rotated in a direction for withdrawing the dust from the brush belts 40, 41 through the openings 47*a*, 47*b*.

Figure 3:
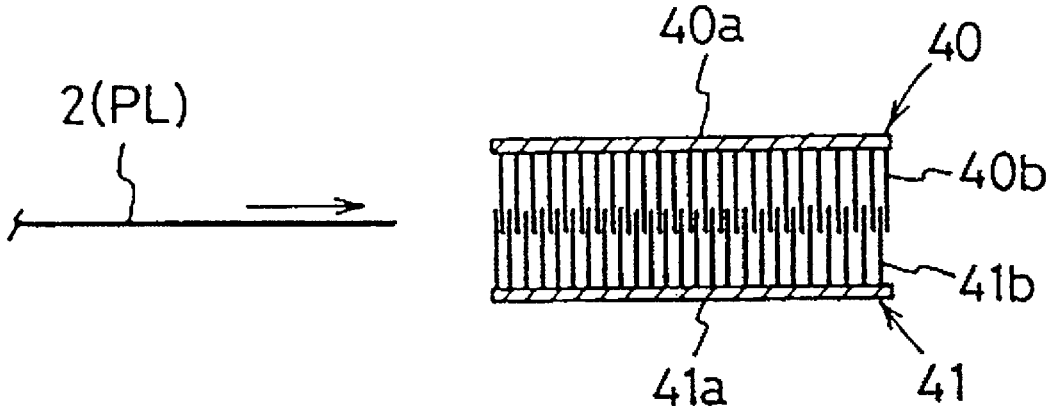
FIG. 3 is an enlarged view of the major portions relating to the first embodiment.

As shown in FIG. 3, the brush belts 40, 41 include bristles 40*a*, 41*b* on the side thereof contacting the negative 2. Where the upper brush belt 40 and the lower brush belt 41 face each other, the leading ends of the upper and lower bristles 40*b*, 41*b* extend with an overlap therebetween.

The negative 2 is forcibly transported through the overlapping bristles 40*b*, 41*b*, so that the upper and lower brush belts 40, 41 come into contact with the front and back surfaces of the negative 2 respectively.

Further, the brush belts 40, 41 are entrained about the drive and driven rollers 42, 43 so that the belts are driven to run 90 degrees transversely relative to the transport direction of the negative 2 denoted by an arrow A in FIG. 2.

Since both the upper brush belt 40 and the lower brush belt 41 are rotated counterclockwise as viewed from the transport direction of the negative 2, a pair of contact portions of the belts 40, 41 contacting the negative 2 are driven in opposite directions to each other at one location on the transport direction of the negative 2.

The drive rollers 42 and the driven rollers 43 are disposed away from each other on the left and right sides of the negative 2, so that curved portions B of the belts 40, 41 formed by the presence of the drive and driven rollers 42, 43 too are disposed away from the negative 2.

The openings 47*a*, 47*b* of the air duct 47 of the suction means DS are disposed to face the first-order one of the curved portions B to which the belts first come into opposition after the contact with the negative 2. More specifically, as both the upper brush belt 40 and the lower brush belt 41 are driven to rotate counterclockwise as viewed relative to the transport direction of the negative 2, the opening 47*a* for the upper brush belt 40 is disposed to face the curved portion B adjacent the fan 48 and the opening 47*b* for the lower brush belt 41 is disposed to face the other curved portion B distant from the fan 48, so as to such dust adhered to the belts 40, 41 located at the respective curved portions B. In this manner, since the dust adhered to the brush belts 40, 41 is eliminated at the first curved portion B after contact with the negative 2, the dust may be eliminated from the brush belts 40, 41 without being scattered about.

At the projection exposure section 5, based on the image information of the negative 2 read by the image sensor 15 in association with feeding of the negative 2 by the rollers 16, 18 and the motor M3, the controller 7 controls the light modulating filter 11 to adjust the irradiation light beam of the projection exposure light source 10 to a color balance according to the color densities of the image of the negative 2, and then this adjusted light beam is irradiated on the negative 2 to print the image information of the negative 2 on the print paper 3.

On the downstream side of the projection exposure section on the transport passage of the print paper, there are disposed rollers 22 for transporting the print paper 3 and a motor M2 for driving the rollers 22.

Though not shown, the developing section D includes a plurality of tanks filled with processing liquids for the development of the exposed print paper 3, such that the print paper 3 is developed through its successive passage through the plurality of tanks.

Next, an exposure operation on the print paper 3 by the image printer 1 will be briefly described.

After activation of the image printer 1, the negative 2 is charged to the projection exposure section 5; then, the motor M3 is activated to start transporting the negative 2.

Upon detection of approaching movement of the negative 2 by means of an unillustrated sensor, the motor M4 of the dust removing apparatus DR is activated to start rotatably driving the brush belts 40, 41.

As the negative 2 is caused to pass the disposing positions of the brush belts 40, 41, dust is removed from the negative 2 by the brush belts 40, 41 and this dust picked up by the brush belts 40, 41 is taken off by being sucked by the suction means DS.

After its passage through the dust removing apparatus DR, image information of a frame 2*a* of the negative 2 is read by the image sensor and this frame 2*a* is transported to an exposure position.

The controller 7 obtains exposure conditions based on the image information read by the image sensor 15 and then produces and presents on the monitor M a simulation image of the information which would result as a photographic print on the print paper 3 if the image were exposed under the obtained exposure conditions.

By observing the display on the monitor M, an operator inputs a correction instruction from a control panel O if a correction is necessary. Otherwise, the operation inputs the exposure conditions directly from the control panel O.

With this input of instruction for exposure, at the projection exposure section 5, the image of the negative 2 is exposed on the print paper S under the determined exposure conditions.

Second Embodiment

A second embodiment will be described next with reference to FIG. 4.

In the above first embodiment, the pair of contact portions of the brush belts 40, 41 of the dust removing apparatus DR contacting respectively the front and back faces of the negative 2 are driven to rotate in the opposite directions to each other at the single location relative to the transport direction of the negative 2. Instead, these contact portions may be driven in a same direction.

Figure 4:
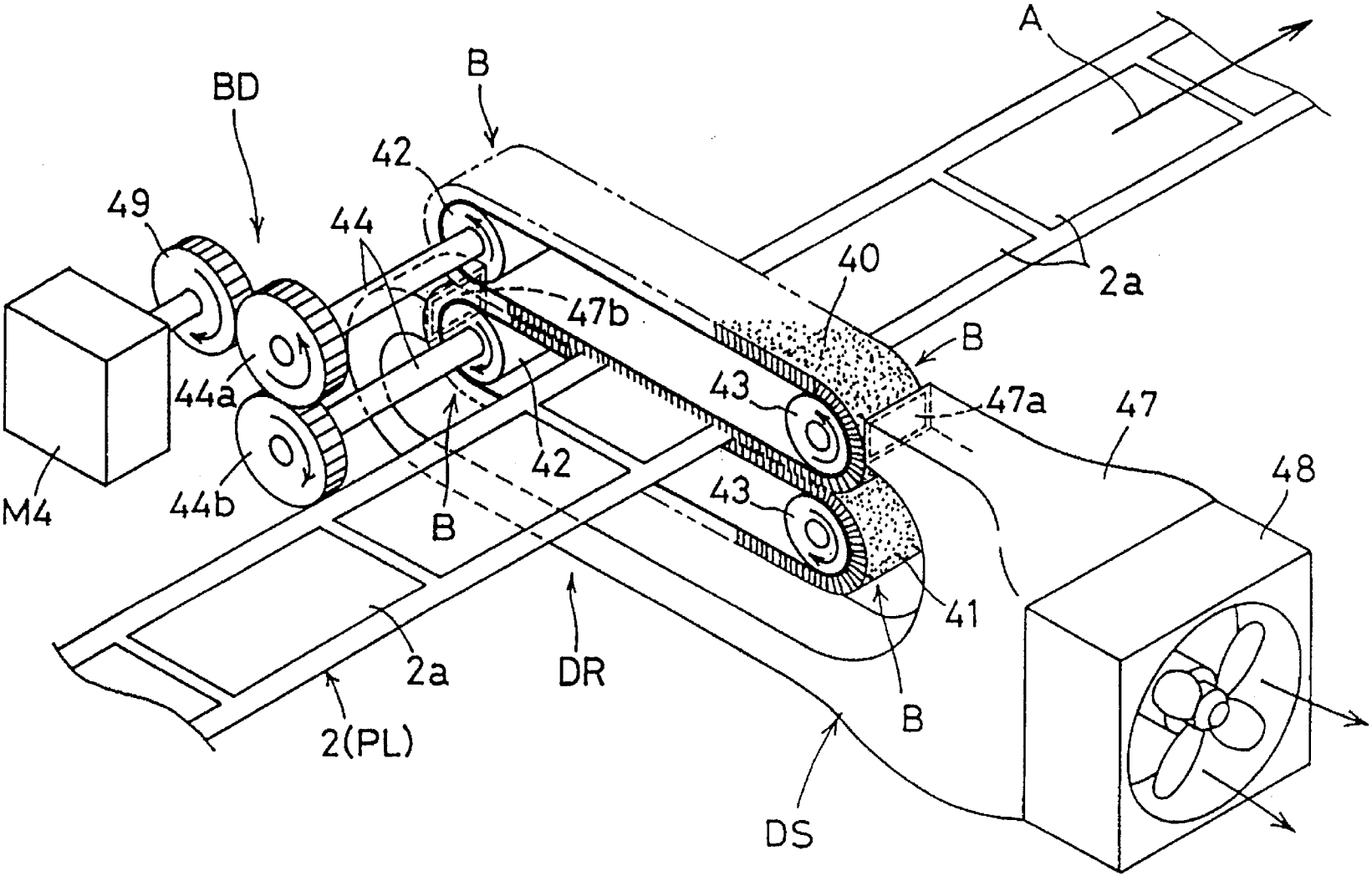
FIG. 4 is a perspective view of major portions relating to a second embodiment of the invention.

That is, as shown in FIG. 4, the two connecting shafts 44 mount gears 44*a*, 44*b* of same number of teeth meshing with each other. And, one gear 44*a* meshes also the drive gear 49 mounted on the rotary shaft of the motor M4.

With this construction, as the motor M4 rotates, the upper brush belt 40 is driven to rotate counterclockwise relative to the transport direction of the negative, while the lower brush belt 41 is driven to rotate clockwise relative to the same.

Incidentally, in both the first embodiment and this second embodiment, the transmission mechanism for transmitting the drive of the motor M4 may be modified in a variety of manners.

Third Embodiment

A third embodiment of a dust removing apparatus as attached to an image printer will be described with corresponding drawings.

Figure 5:
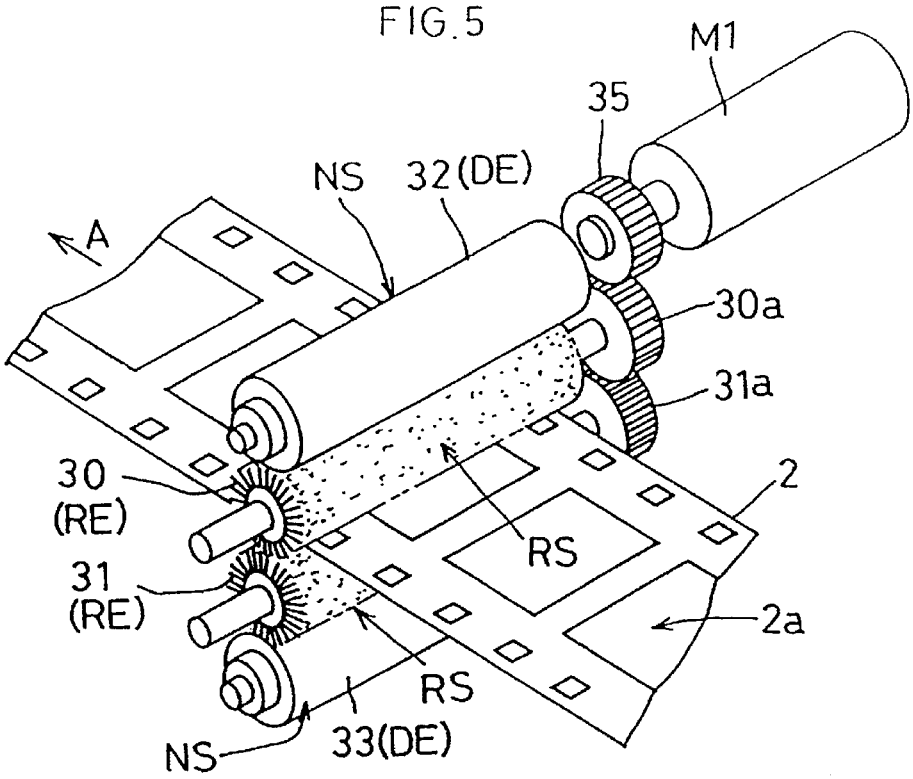
FIG. 5 is a perspective view of major portions relating to a third embodiment of the invention.
Figure 6:
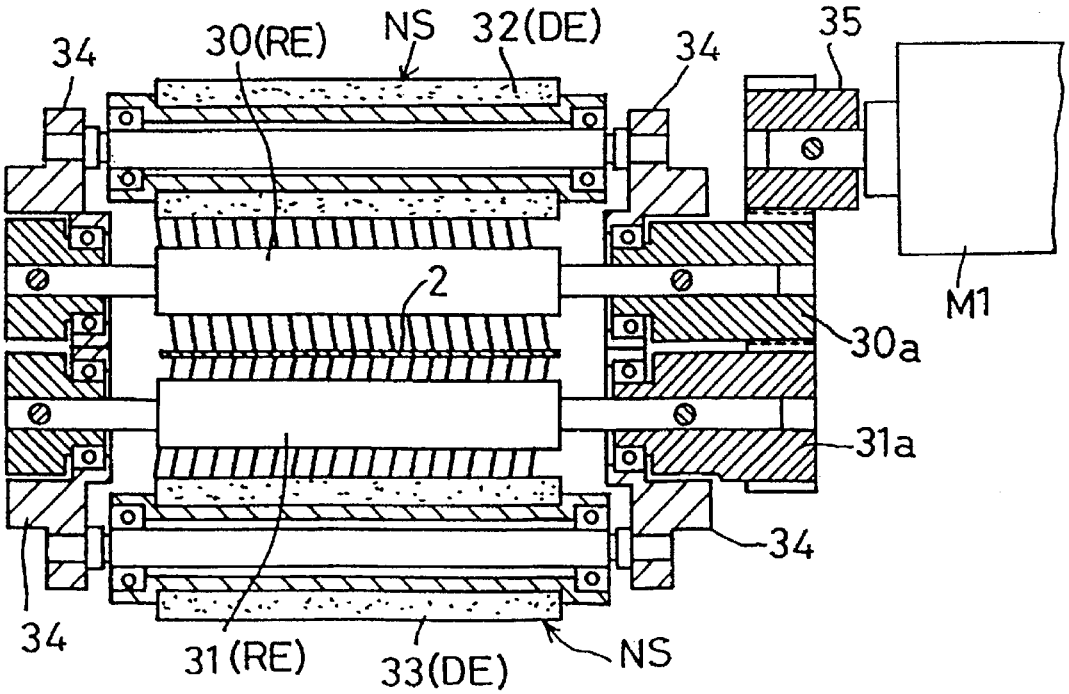
FIG. 6 is a section view of the major portions relating to the third embodiment.
Figure 7:
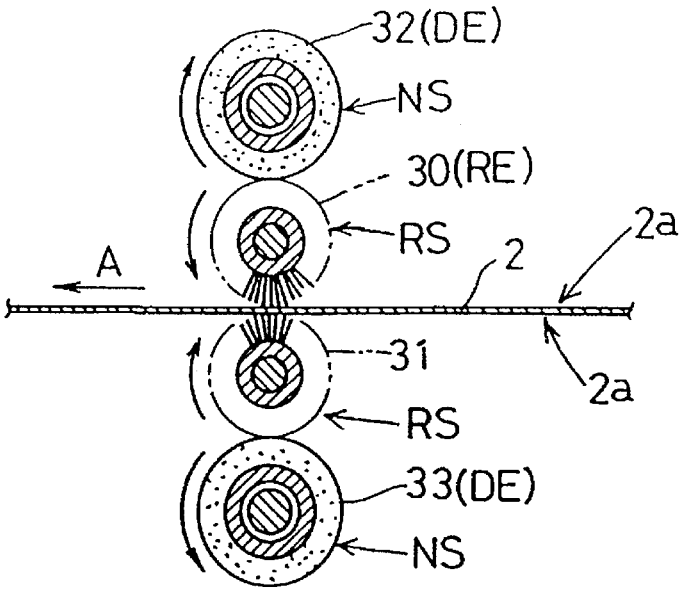
FIG. 7 is a side view of the major portions relating to the third embodiment.

As shown in FIGS. 5 through 7, a dust removing apparatus DR of this embodiment includes brush rollers 30, 31 disposed upwardly and downwardly across the transport passage of the negative 2 as dust removing members RE for removing dust from the negative 2 through contact therewith, adhesive rollers 32, 33 disposed upwardly and downwardly of the brush rollers 30, 31 as take-off members DE for taking off the dust adhered to the brush rollers 30, 31, and a motor M1 as drive means for rotatably driving the brush rollers 30, 31.

The upper brush roller 30 and the lower brush roller 31 are of a same substantially cylindrical configuration, and a peripheral face of each cylindrical roller includes brush bristles made of e.g. PVC to obtain electric conductivity, so that the peripheral face constitutes a dust removing face RS.

Further, the upper adhesive roller 32 and the lower adhesive roller 33 are of a same substantially cylindrical configuration and formed mainly of urethane resin material, and the peripheral face of each cylindrical roller, i.e. the face formed of the urethane resin material, is applied with an adhesive material to constitute an adhesive face NS.

As shown in a section view of FIG. 6, the brush rollers 30, 31 and the adhesive rollers 32, 33 are rotatably supported via bearings to a stationary support frame 44, and leading ends of the bristles of the upper and lower brush rollers 30, 31 are placed in contact with the adhesive faces NS of the adhesive rollers 32, 33, respectively.

As shown in FIGS. 5 and 6, the drive of the motor M1 is transmitted to the respective brush rollers 30, 31 through meshing between the drive gear 35 mounted on the rotary shaft of the motor M1 and a driven gear 30*a* mounted on a rotary shaft of the upper brush roller 30 and meshing between this driven gear 30*a* and a driven gear 31*a* mounted on a rotary shaft of the lower brush roller 31.

As shown in FIG. 7, relative to the transport direction of the negative 2 denoted with an arrow A, the upper brush roller 30 is driven to rotate counterclockwise while the lower brush roller 31 is driven to rotate clockwise.

The adhesive rollers 32, 33 are not directly driven by the motor M1, but through their contact with the brush rollers 30, 31, the upper adhesive roller 32 is rotated clockwise and the lower adhesive roller 33 is rotated counterclockwise in FIG. 7.

As the brush rollers 30, 31 and the adhesive rollers 32, 33 are rotated in the above-described manners, i.e. various portions of the dust removing faces RS are continuously and alternately brought to the dust removing positions, namely, the positions contacting the negative 2, dust adhered to the film faces 2*a* of the negative 2 transported in the direction of arrow A is picked up without being scattered over to the upstream side of the transport direction of the negative 2, and this dust adhered to the dust removing faces RS of the brush rollers 30, 31 is eliminated therefrom by the adhesive force of the adhesive faces NS of the adhesive rollers 32, 33 at non-removing positions on the opposite side to the contact positions with the negative 2.

The dust adhered to the adhesive faces NS of the adhesive rollers 32, 33 may be cleaned periodically.

Next, an exposure operation on the print paper 3 by the image printer 1 will be briefly described.

After activation of the image printer 1, the negative 2 is charged to the projection exposure section 5; then, the motor M3 is activated to start transporting the negative 2.

Upon detection of approaching movement of the negative 2 by means of an unillustrated sensor, the motor M1 of the dust removing apparatus DR is activated to start rotatably driving the brush rollers 30, 31.

As the negative 2 is caused to pass the disposing positions of the brush rollers 30, 31, dust is removed from the negative 2 by the brush rollers 30, 31 and this dust picked up by the brush rollers 30, 31 is eliminated therefrom by the adhesive rollers 32, 33.

After its passage through the dust removing apparatus DR, image information of a frame 2*a* of the negative 2 is read by the image sensor and this frame 2*a* is transported to an exposure position.

The controller 7 obtains exposure conditions based on the image information read by the image sensor 15 and then produces and presents on the monitor M a simulation image of the information which would result as a photographic print on the print paper 3 if the image were exposed under the obtained exposure conditions.

By observing the display on the monitor M, an operator inputs a correction instruction from the control panel O if a correction is necessary. Otherwise, the operation inputs the exposure conditions directly from the control panel O.

With this input of instruction for exposure, at the projection exposure section 5, the image of the negative 2 is exposed on the print paper 3 under the determined exposure conditions.

Fourth Embodiment

Next, a fourth embodiment of the invention will be described with reference to FIG. 8.

In the above third embodiment, the dust sticking to the negative 2 is eliminated only by the brushy peripheral faces of the brush rollers 30, 31. Instead, as shown in FIG. 8, the brush rollers 30, 31 as the dust removing members RE, may include, at right and left ends thereof as predetermined positions, auxiliary adhesive faces 30*b*, 31*b* having adhesive property so as to eliminate the dust from the negative 2 with a stronger force than provided by the brush faces.

More particularly, the auxiliary adhesive faces 30*b*, 31*b* will be provided only at such portions corresponding to particular portions of the negative where more thorough dust cleaning is desired. In this respect, through appropriate adjustment of mixing ratio of the materials forming the adhesive material used, the adhesive force of the auxiliary adhesive faces 30*b*, 31*b* is rendered weaker than the adhesive force of the adhesive faces NS of the adhesive rollers 32, 33, such that the dust adhered to the auxiliary adhesive faces 30*b*, 31*b* may be reliably eliminated by the adhesive rollers 32, 33.

Figure 8:
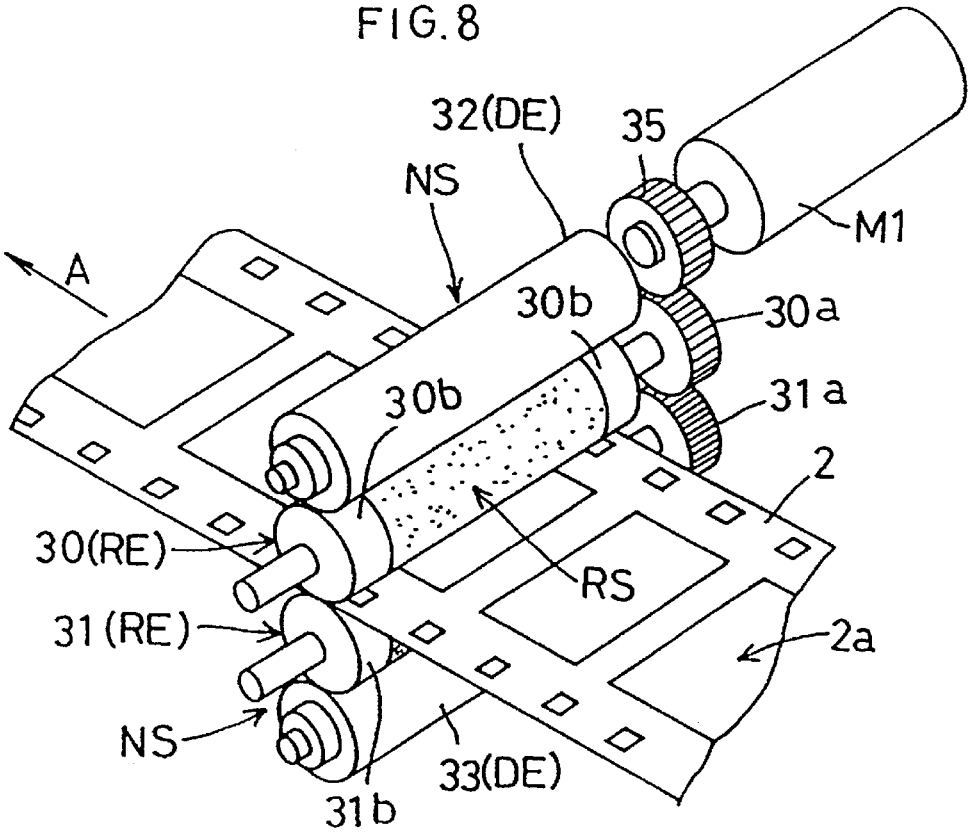
FIG. 8 is a perspective view of major portions relating to a fourth embodiment of the invention.

In the sample condition shown in FIG. 8, the positions of the auxiliary adhesive faces 30*b*, 31*b* are caused to correspond to the position of perforations of the negative, so that these areas of perforations may be cleaned more thoroughly than the other portion of the negative so as to assure higher reliability for a reading operation of the perforations per se an optical sensor and a reading operation of a DX code recorded in the vicinity of the perforations by means of optical sensors.

Incidentally, in the case of the construction shown in FIG. 8, the auxiliary adhesive faces 30*b*, 31*b* are rotatable together with the brush rollers 30, 31. Instead, the roller portions forming the auxiliary adhesive faces 30*b*, 31*b* and those portions of the adhesive rollers 32, 33 contacting the auxiliary adhesive faces 30*b*, 31*b* may be rendered freely rotatable, so as to smooth the dust removal and transportation of the negative 2.

Fifth Embodiment

Next, a fifth embodiment of the invention will be described with reference to corresponding drawings.

Figure 9:
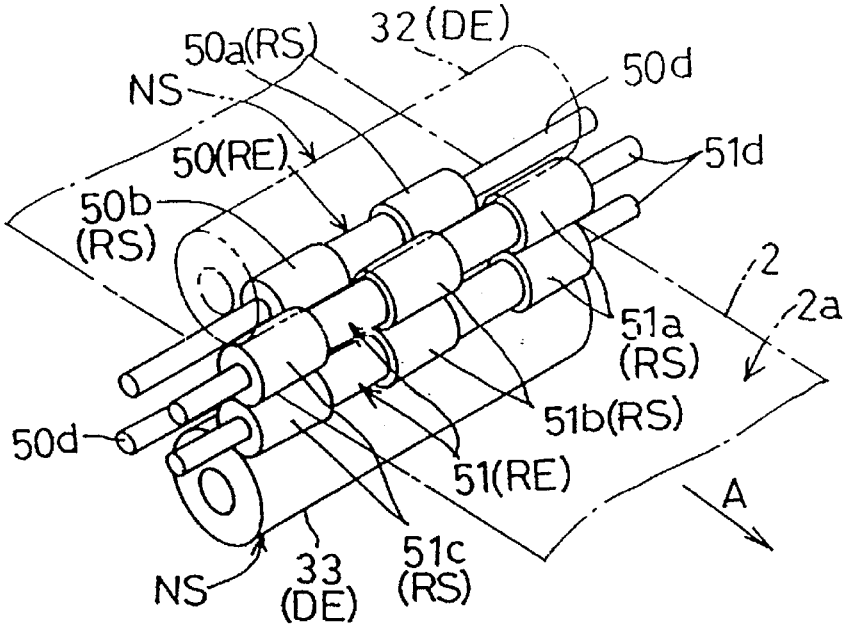
FIG. 9 is a perspective view of major portions relating to a fifth embodiment of the invention.
Figure 10:
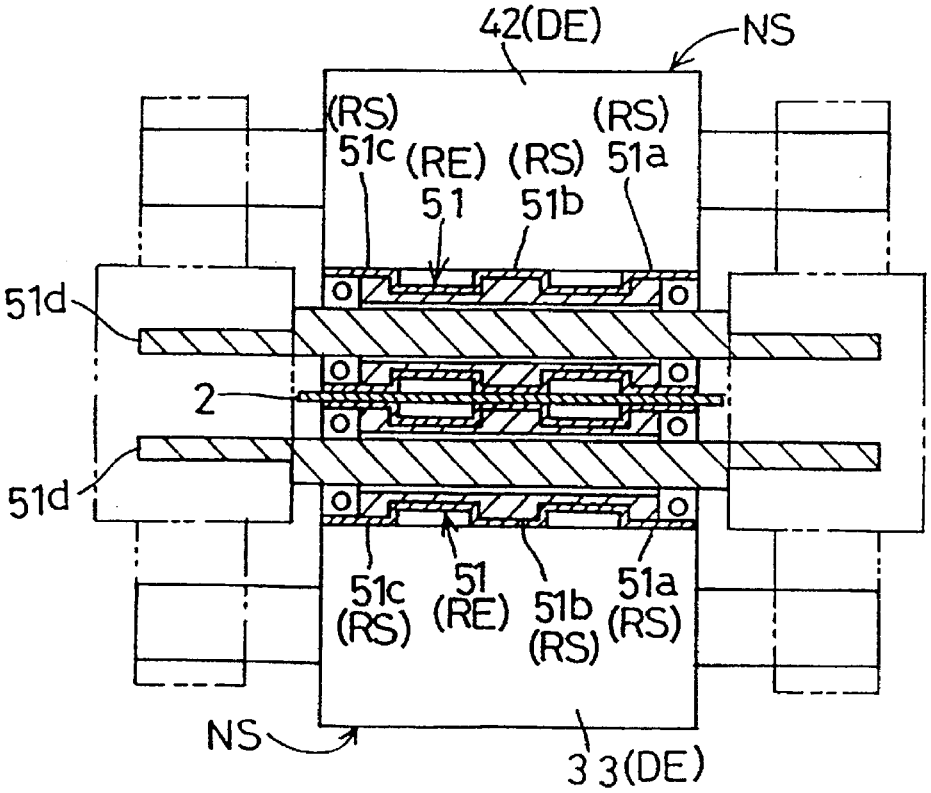
FIG. 10 is a section view of the major portions relating to the fifth embodiment.
Figure 11:
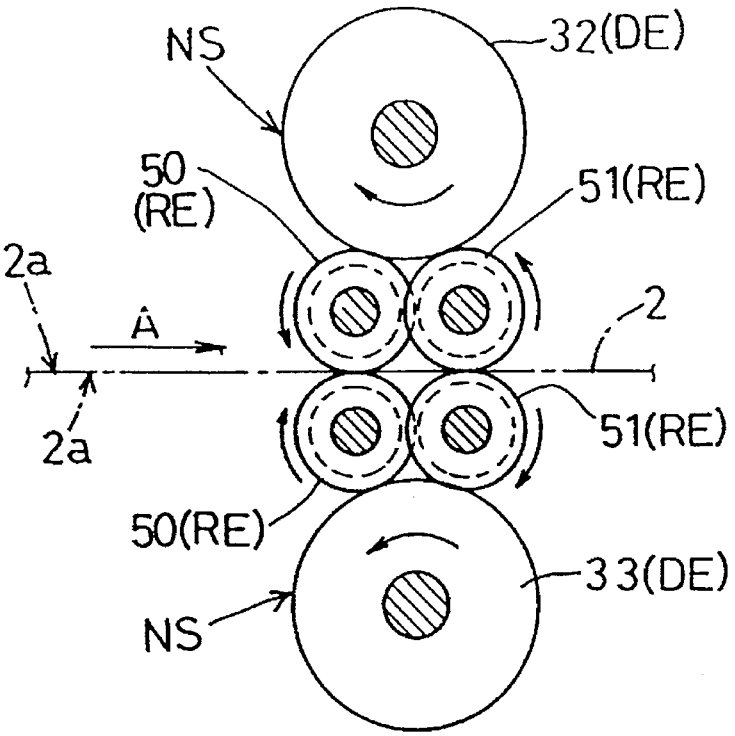
FIG. 11 is a side view of the major portions relating to the fifth embodiment.
Figure 12:
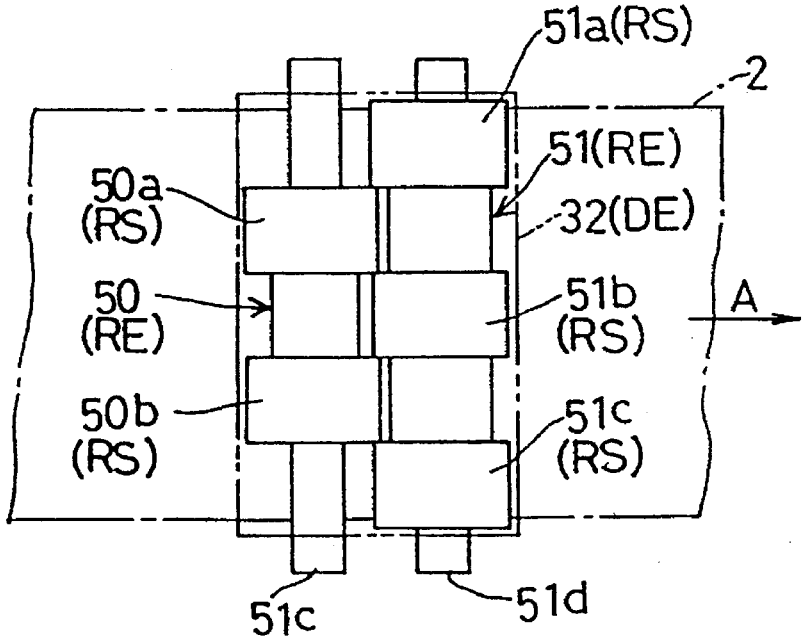
FIG. 12 is a plan view of the major portions relating to the fifth embodiment of the invention.

In the foregoing third embodiment, the dust adhered to the negative 2 is picked up by the brushy dust removing faces RS of the brush rollers 30, 31. Alternatively, as shown in FIGS. 9 through 11, as alternative dust removing members RE for removing the dust from the front and back film faces 2*a* of the negative 2, two segmented type adhesive rollers 50, 51 may be provided to contact the negative from the above and under the negative 2 one after the other in the transportation direction of the negative 2.

Of the two segmented type adhesive rollers 50, 51, the adhesive roller 50 disposed on the upstream side relative to the transportation direction of the negative 2 includes, at two separate portions thereof, adhesive faces 50*a*, 50*b* as the dust removing faces. The other adhesive roller 51 disposed on the downstream side relative to the transportation direction of the negative 2 includes, at three separate portions thereof, adhesive faces 51*a*, 51*b*, 51*c* as the dust removing faces. The adhesive faces 50*a*, 50*b* of the roller 50 and the adhesive faces 51*a*, 51*b*, 51*c* of the roller 51 are disposed alternately relative to the width of the negative 2 with leading ends thereof being slightly overlapped with each other.

Through the above-described arrangement of the adhesive faces 50*a*, 50*b*, and the adhesive faces 51*a*, 51*b*, 51*c*, as viewed from the longitudinal direction of the negative 2, at any location throughout the entire width of the negative 2, at least one of the adhesive faces 50*a*, 50*b* or the adhesive faces 51*a*, 51*b*, 51*c* is present, so that the entire faces of the negative 2 may be subjected to the dust removal operation.

Like the foregoing embodiment, the adhesive faces 50*a*, 50*b* and the adhesive faces 51*a*, 51*b*, 51*c* are placed in contact with the adhesive rollers 32, 33 at the non-removing positions substantially on the opposite side to the contacting positions with the negative 2. Furthermore, through the appropriate adjustment of mixing ratio of adhesive materials used, the adhesive force of these adhesive faces 50*a*, 50*b*, 51*a*, 51*b*, 51*c* is rendered weaker than the adhesive force of the adhesive faces NS of the adhesive rollers 32, 33, such that the dust adhered to the faces 50*a*, 50*b*, 51*a*, 51*b*, 51*c* from the negative 2 may be reliably removed therefrom by the adhesive rollers 32, 33.

The segmented type adhesive rollers 50, 51 having the above-described constructions are disposed side-symmetrically across the transporting position of the negative 2 and remove the dust from the front and back faces 2*a* of the negative 2.

Incidentally, the segmented type adhesive rollers 50, 51 are rotatably driven through their contact with the transported negative 2 and various portions of the dust removing faces RS are continuously and alternately brought to the positions contacting the negative 2. Hence, no motor is absolutely specially needed for driving these segmented type adhesive rollers 50, 51. Yet, in order to reduce load on the motor M3 which transports the negative 2, a motor may be provided for this special purpose as well.

As to the placement of the segmented type adhesive rollers 50, 51, instead of the above-described placement in which the leading ends of the adhesive faces 50*a*, 50*b* are slightly overlapped with the leading ends of the adhesive faces 51*a*, 51*b*, 51*c*, the rollers 50, 51 may be disposed away from each other relative to the longitudinal direction of the negative 2, and the lateral widths of the faces 50*a*, 50*b* and faces 51*a*, 51*b*, 51*c* may be extended respectively, so that the widthwise ends of the adhesive faces 50*a*, 50*b*, and those of the adhesive faces 51*a*, 51*b*, 51*c* are overlapped with each other relative to the longitudinal direction of the negative 2. Further, more than three segmented type adhesive rollers 50, 51 may be employed. And, the number of adhesive faces RS may be conveniently varied.

Further, instead of the segmented type adhesive rollers 50, 51, the substantially cylindrical adhesive rollers like the adhesive rollers 32, 33 may be employed as well.

Sixth Embodiment

Next, a sixth embodiment of the invention will be described with reference to FIGS. 13 through 16.

Figure 13:
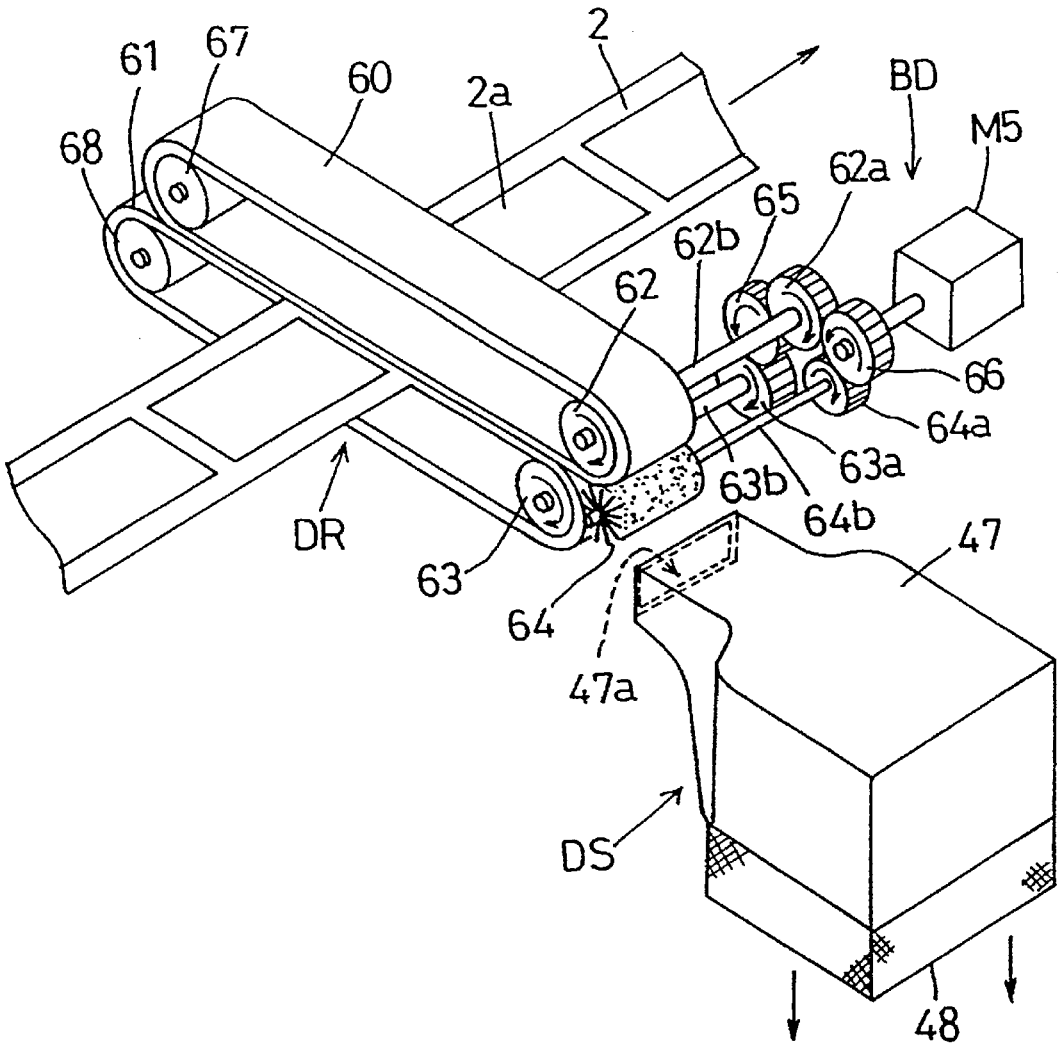
FIG. 13 is a perspective view of major portions relating to a sixth embodiment of the invention.

As shown in FIG. 13, a dust removing apparatus of this embodiment includes, as endless belt type dust removing members RE, an upper cleaning belt 60 and a lower cleaning belt 61 disposed respectively above and under the negative 2. The apparatus further includes suction means DS for sucking dust from the dust adhered to the upper and lower cleaning belts 60, 61, and drive means BD for rotatably driving the upper and lower cleaning belts 60, 61. The suction means DS functions ad the take-off member DE.

The drive means BD includes a drive roller 62 and a drive roller 67 about which the upper cleaning belt 60 is entrained, a drive roller 63 and a drive roller 68 for driving the lower cleaning belt 61, a driven gear 62*a* mounted on a connector shaft 62*b* to be driven in unison with the drive roller 62 mounted on the same connector shaft, a driven gear 63*a* mounted on a connector shaft 63*b* to be driven in unison with the drive roller 63 mounted on the same connector shaft, a motor M5 for rotatably driving the cleaning belts 60, 61, a motor roller 66 attached to a leading end of a rotary shaft of the motor M5, a substantially cylindrical brush roller 64 disposed so as to contact with both a curved portion B of the upper cleaning belt 60 and a curved portion B of the lower cleaning belt 61, a brush gear 64*a* mounted on a connector shaft 64*b* to be rotatable in unison with the brush roller 64 mounted on the same connector shaft, and an idle gear 65 for matching the rotation directions of the drive rollers 62, 63.

The suction means DS includes an air duct 47 having an opening 47*a* adjacent an outer periphery of the brush roller 64 and a fan 48 communicated with the air duct 47.

Figure 15:
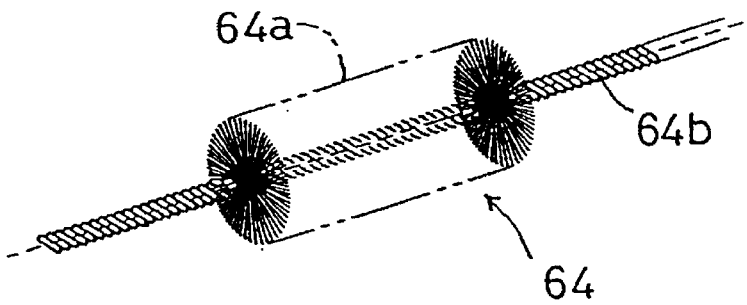
FIG. 15 is an enlarged view of a brush roller.

The detailed construction of the brush roller 64 is shown in FIG. 15. As shown, the roller includes a shaft 64*b* made of stainless steel and bristles 64*a* mounted on the periphery of the shaft 64*b*.

Dust adhered to the upper and lower cleaning belts 60, 61 is picked up by the brush roller 46 and this dust picked up by the roller 46 is eliminated by being sucked by the suction means DS.

Figure 16:
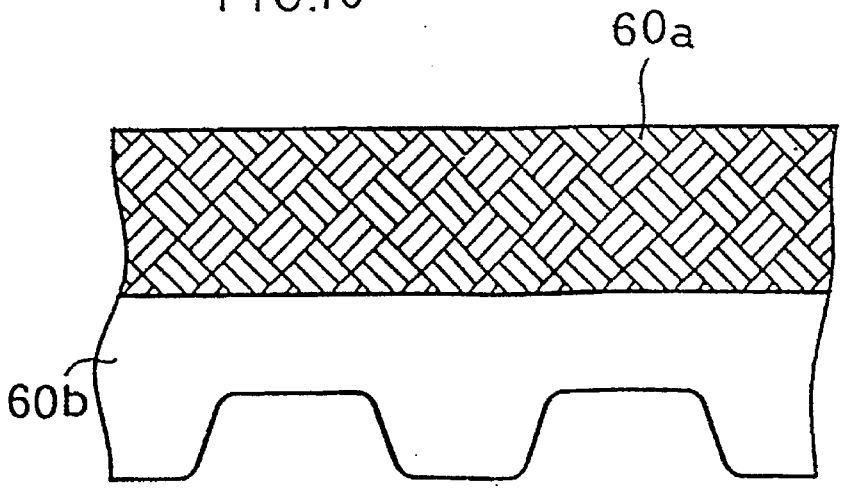
FIG. 16 is an enlarged view of a cleaning belt.

FIG. 16 is an enlarged view of an end face of the cleaning belts 60, 61. A side portion of this belt 60 or 61 contacting the negative 2 is formed as an urethane cloth portion 60*a* and the opposite side portion is formed as a timing-belt portion 60*b*.

Outer peripheries of the drive rollers 62, 63 and of the driven rollers 66, 67 are configured so as to engage with the timing-belt portion 60*b*.

In comparison with the brush belts 40, 41 used in the first embodiment, the construction using this urethane cloth portion is advantageous for not producing dust of its own, so that the dust removing operation may be effected more efficiently. That is to say, in the case of the brush belts 40, 41, the brushes may produce dust of their own, so that the suction means DS needs to have a sufficiently large suction capacity. Incidentally, this urethane cloth portion 60*a* is formed of a base of velvet covered with a urethane layer.

As the motor gear 66 is driven counterclockwise in FIG. 13 by the motor M5, the drive roller 62 is rotated clockwise. The rotation of the motor gear 66 is transmitted via the driven gear 62*a* and the idle gear 65 to the driven gear 63*a* to rotate the drive roller 63 clockwise.

Accordingly, since both of the upper cleaning belt 60 and the lower cleaning belt 61 are driven to rotate clockwise as viewed from the transport direction of the negative 2, the pair of contact portions of the cleaning belts 60, 61 contacting the front and back faces of the negative 2 are rotated in the opposite direction to each other at the single location on the transport direction of the negative 2.

As the drive rollers 62, 63 and the driven rollers 67, 68 are disposed away from each other on the right and left sides relative to the negative the curved portions B of the cleaning belts 60, formed by the drive rollers 62, 63 and the driven rollers 67, 68 too are located away from the negative 2.

Further, the brush roller 64 is rotated clockwise in FIG. 13. Then, by utilizing a centrifugal force association with this roller rotation, the dust adhered to the brush roller 64 may be removed by the sucking force of the fan 48 efficiently. Further, by forming the brush roller 64 of electrically conductive material, it is possible to prevent electric charging of the negative 2.

Figure 14:
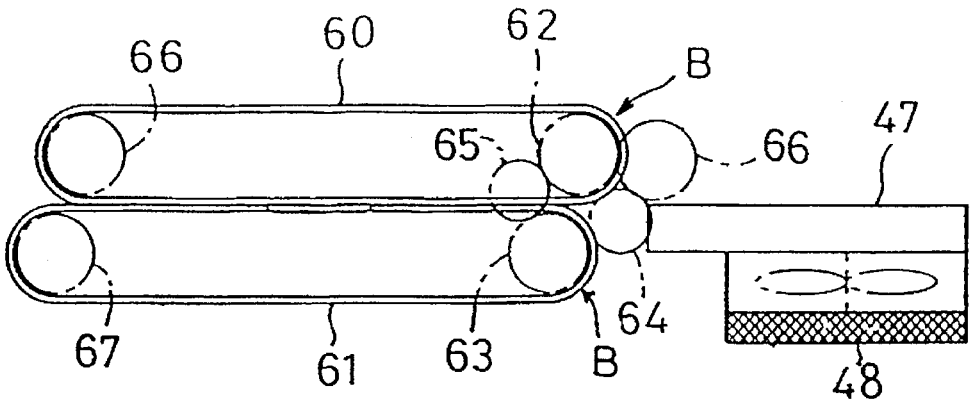
FIG. 14 is a side view of major portions relating to the sixth embodiment of the invention.

As may be understood from the side view of FIG. 14, the drive roller 62 and the drive roller 63 are displaced to the right and left from each other relative to the transport direction of the negative 2. With this placement, the outer periphery of the brush roller 64 may be efficiently placed in contact with the curved portions B of the upper and lower cleaning belts 60, 61.

As described above, the dust is removed at a position different from the position of the negative 2 as the dusty surface to be treated, so that there occurs no inconvenience of reverse attachment of the dust to the negative 2.

Seventh Embodiment

Figure 17:
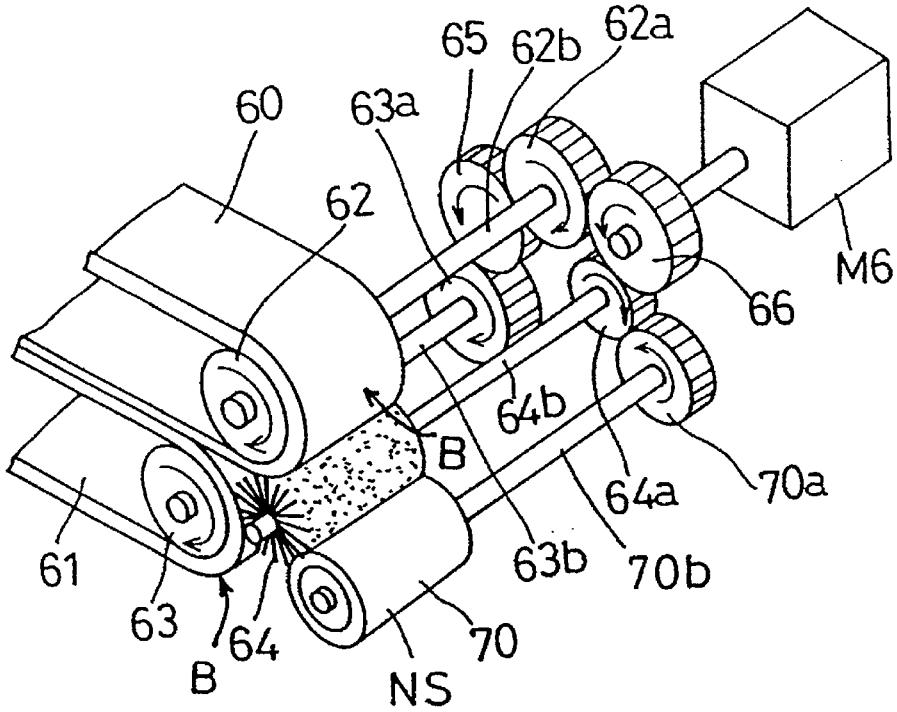
FIG. 17 is a perspective view of major portions relating to a seventh embodiment of the invention.

Next, a seventh embodiment of the invention will be described with reference to FIG. 17.

This embodiment differs from the sixth embodiment in that instead of the suction means DS comprised of the air duct 47 and the fan 48 there is provided a substantially cylindrical adhesive roller 70. This adhesive roller 70 is integrally connected with the driven gear 70*a* via a common connector shaft 70*b*. That is to say, the dust adhered to the brush roller 64 is eliminated by the adhesive roller 70.

This adhesive roller 70 is a substantially cylindrical member formed mainly of urethane resin material and the outer peripheral face of the cylindrical member is coated with adhesive material to provide an adhesive face NS.

In order to drive the adhesive roller 70, the motor M6 rotates the motor gear 66 and this rotation is transmitted via the driven gear 64*a* to a driven gear 70*a*.

In comparison with the foregoing construction using the air duct 47 and the fan 48, this construction using the adhesive roller 70 is advantageous for allowing size reduction of the entire apparatus.

Eighth Embodiment

Figure 18:
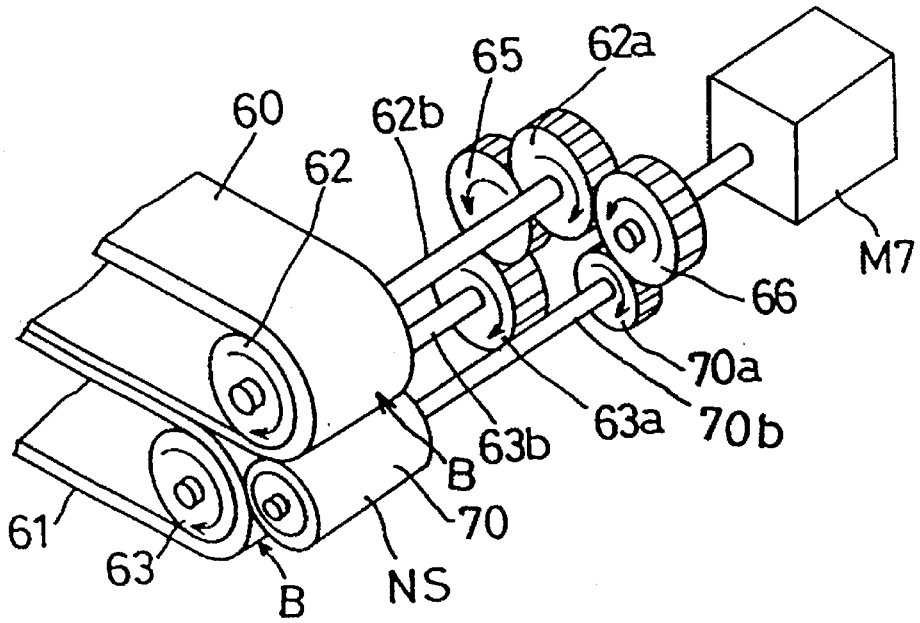
FIG. 18 is a perspective view of major portions relating to an eighth embodiment of the invention.

An eighth embodiment of the invention will be described next with reference to FIG. 18.

In this eighth embodiment, the outer peripheral face of the adhesive roller 70 is placed in contact with the upper and lower cleaning belts 60, 61. With this construction, the dust may be removed directly by the adhesive roller 70 without the brush roller, so that this construction allows further reduction in the size of the entire apparatus in comparison with the apparatus of the seventh embodiment.

Ninth Embodiment

A ninth embodiment of the invention will be described next with reference to FIGS. 19, 20 and 21.

This embodiment relates to a further modified dust removing apparatus construction using belts.

For a dust removing operation, the negative 2 must pass through the dust removing face RS. That is, the negative 2 must pass between the upper belt and lower belt. As means for facilitating this passage, it is conceivable to cause the upper belt and the lower belt to cross each other as viewed from above the film transporting plane.

However, with such means, if the leading end of the film is curled or bent, a jamming of the negative may occur.

In this respect, according to the instant embodiment, the dust removing faces RS are rendered to open and close relative to each other, and, more particularly, the dust removing faces are movable between a first position where the faces do not provide dust removing action to the negative 2 and a second position where the faces provide the removing action to the same.

Figure 19:
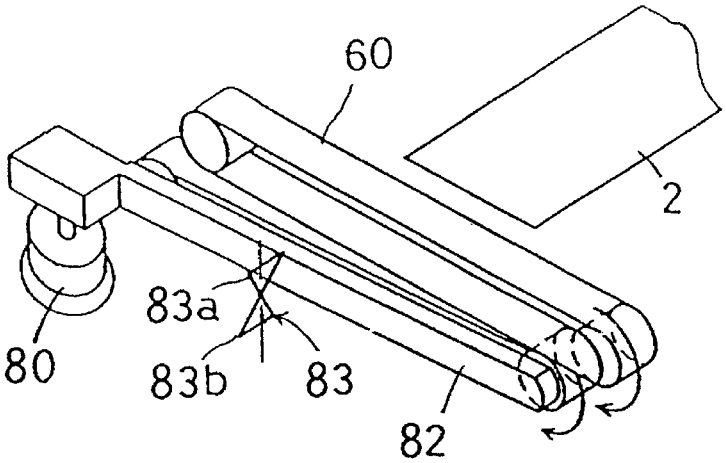
FIG. 19 is a perspective view of major portions relating to a ninth embodiment under a condition before insertion of a negative film.
Figure 20:
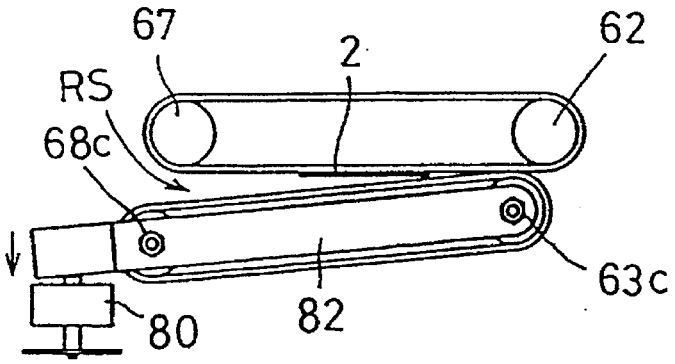
FIG. 20 is a side view of the major portions relating to the ninth embodiment under the condition before the insertion of the negative film.

FIG. 19 illustrates the condition where the dust removing faces RS are located at the first position and FIG. 20 illustrates the further condition where the faces RS are located at the second position.

Figure 21:
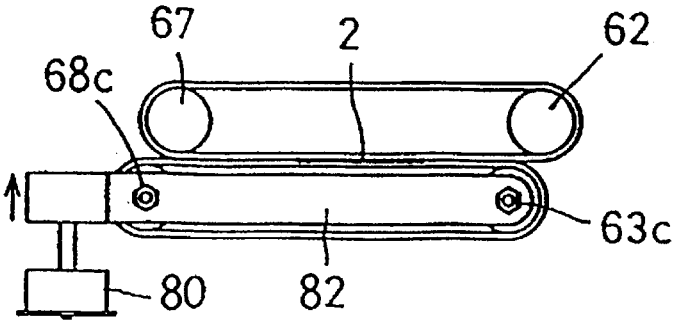
FIG. 21 is a side view of the major portions relating to the ninth embodiment under a further condition after the insertion of the negative film.

Incidentally, the detailed constructions of the entire dust removing apparatus are not shown in FIGS. 19, 20 and 21.

A guide member 82 is connected to an output portion of a solenoid 80 and the guide member 82 and the lower cleaning belt 61 are connected integrally with each other. More specifically, the member 82 and the belt 61 are connected via shafts 63*a*, 68*c* disposed at the centers of the drive roller 63 and the driven roller 68 respectively. The solenoid 80 functions as drive means for driving the dust removing faces RS to be opened and closed relative to each other, An optical sensor 83 including a light emitting element 83*a* such as a light emitting diode and a light receiving element 83*b* such as a light receiving transistor is provided for detecting presence and absence of the negative 2. This optical sensor functions as detecting means for detecting presence and absence of the negative 2.

When the negative 2 is absent, as illustrated in FIG. 19, the guide member 82 is slightly inclined as viewed from the transport direction of the negative. So that, the dust removing faces RS are opened relative to each other to allow smooth insertion of the negative 2 between the dust removing faces (i.e. between the upper and lower cleaning belts 60, 61).

When the negative 2 has reached the dust removing faces, this movement of the negative 2 is detected by the optical sensor 83. Upon this detection, the solenoid 80 is switched ON, so as to drive the guide member 82 from the first position shown in FIG. 19 or FIG. 20 to the second position shown in FIG. 21. Thereafter, the unillustrated dust removing apparatus is activated for effecting a dust removal operation.

After completion of the dust removing operation on the negative 2, the negative 2 is moved away from the dust removing faces RS. This movement of the negative 2 away from the dust removing faces RS too is detected by the optical sensor 83 and with this detection the solenoid 80 is switched OFF. Whereby, the dust removing faces RS are returned from the second position to the first position and maintained at this position until insertion of a next negative 2.

The above operations are automatically controlled by the controller 7.

Other Embodiments

The first and second embodiments employ, as the dust removing members in the form of endless belts, the brush belts 40, 41 having the brush side face contacting the negative 2. Instead, the dust removing members may comprise e.g. cloth material in the form of endless belts.

In the first, second and sixth through ninth embodiments, the belts 40, 41 of the dust removing apparatus DR are entrained so as to transverse the transport direction of the negative 2 at 90 degrees. Instead, these belts may be disposed at any other angle relative to the transport direction, or may be disposed parallel with the transport direction of the negative 2 so as to minimize the width relative to the transport direction of the negative 2.

Further, the upper belt 40, 60 and the lower belt 41, 61 may be arranged to cross each other in the plan view.

In the first, second and sixth through ninth embodiments, the upper belt 40, 60 and the lower belt 41, 61 of the dust removing apparatus DR are arranged to contact respectively the front and back faces of the negative 2 at one location on the transport direction of the negative 2. Instead, the upper belt 40, 60 and the lower belt 41, 61 may be arranged to contact the negative 2 at different locations on the transport direction of the negative 2.

In the first, second and sixth through ninth embodiments, in order to contact the front and back faces of the negative 2, the two belts, i.e. the upper belt 40, 60, and the lower belt 41, 61 are provided. Instead, a single belt may be provided in such a manner that the belt is entrained in the substantially C-shaped arrangement to be driven to contact the front and back faces of the negative 2.

In the first and second embodiment, the openings 47*a*, 47*b* of the air duct 3 of the suction means DS of the dust removing apparatus DR are disposed to face the first one of the curved portions B of the brush belts 40, 41 in the order after the contact with the negative 2. Instead, the openings may be provided for all the curved portions B or at any other locations than the curved portions B.

The suction means DS may be provided in a plurality or this suction means DS may be eliminated at all.

In the first, second and sixth through ninth embodiments, the brush belts 40, 41, 60, 61 are each entrained about the drive roller 42 and the driven roller 43. Instead, two upper and lower belts each entrained about one roller may be arranged to contact the negative 2 from the upper and lower sides thereof.

In the third and fourth embodiments, the cylindrical brush rollers 30, 3 are employed for removing the dust from the negative 2. Instead, a cloth member in the form of a belt may be entrained to contact the negative 2 and the dust adhered to the cloth member may be eliminated therefrom by the adhesive rollers 32, 33.

Further, a belt-like base member having a brush face may be arranged to be driven to rotate in contact with the negative 2.

In the third through fifth and eighth embodiments, the adhesive rollers 32, 33, 70 constitute the take-off members DE. Instead, a planar adhesive sheet may be fed serially to come into contact with the dust removing face RS located at the non-removing position.

In the ninth embodiment, the dust removing apparatus employs the endless belts 60, 61. Instead, the construction of this embodiment may be applied to the further constructions of the third through fifth embodiments using the cylindrical dust removing members. Further, in place of the construction in which only the lower belt is movable, both the upper and lower belts may be rendered movable.

In the ninth embodiment, the presence and absence of the negative 2 is detected by the optical sensor 83. Instead, this may be detected magnetically or mechanically.

In all the foregoing embodiments, the dust removing apparatuses are used in combination with an image printer system. Instead, the apparatuses may be used in combination with any other device or system using a photosensitive material such as a film projector. Or, the apparatus may be used as an independent apparatus.

In all the foregoing embodiments, the dust removing apparatuses are used in combination with an image printer system for removing dust from a photographic negative film 2. Instead, the apparatuses may be used for removing dust from any other elongate band-like member such as a VTR tape, an audio tape or the like.

The apparatuses may be further used for dust removal of any other object of any configuration other than the band-like configuration.

In all the foregoing embodiments, the dust removing apparatus DR is constructed to remove dust from both the front and back faces of the photographic negative film 2 as the elongate band-like material. Instead, the apparatus may be modified to remove dust from only one side of the material.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A dust removing apparatus for removing dust from opposed front and back faces of a sheet-like photosensitive material moving on a transport path, said apparatus comprising first endless belt means entrained to contact the front face of a sheet-like photosensitive material, second endless belt means entrained to contact the back face of the sheet-like photosensitive material, drive means for driving said first and second endless belt means, and take off means for removing dust from said first and second belt means.

2. A dust removing apparatus as in claim 1 wherein said first and second belt means are driven to move transversely of said transport path.

3. A dust removing apparatus as in claim 2 wherein said first and second belt means are entrained to contact opposed faces of said sheet-like material at a common location, and are driven to move in opposite directions at said common location.

4. A dust removing apparatus as in claim 1 wherein said take-off means comprises suction means which removes dust from said first and second belt means.

5. A dust removing apparatus as in claim 4 wherein said first and second belt means each have a curved section remote from said photosensitive material, said take-off means removes dust from said curved sections.

6. A dust removing apparatus as in claim 1 wherein said first and second belt means are each provided with a brushy face for removing dust from said photosensitive material.

7. A dust removing apparatus as in claim 1 wherein said take-off means comprises an adhesive roller for removing dust from said first and second belt means.

8. A dust removing apparatus as in claim 1 wherein said take-off means comprises a brush roller for removing dust from said first and second belt means.

9. A dust removing apparatus as in claim 8 wherein said brush roller is electrically conductive.

10. A dust removing apparatus as in claim 8 wherein said take-off means further comprises suction means for removing dust from the brush roller.

11. A dust removing apparatus as in claim 8 wherein said take-off means further comprises an adhesive roller for removing dust from said brush roller.

12. A dust removing apparatus as in claim 1 wherein one of said first and second belt means is movable from a first position where it does not contact said sheet-like photosensitive material to a second position where it contacts said sheet-like photosensitive material.

13. A dust removing apparatus as in claim 12 further comprising means for detecting when said sheet-like photosensitive material is in contact with the other of said first and second belt means, and means for moving said one of said first and second belt means from said first position to said second position in response to said detection.

* * * * *